United States Patent [19]

Sumiyoshi et al.

[11] 4,294,213

[45] Oct. 13, 1981

[54] FUEL SUPPLYING DEVICE FOR USE IN FUEL INJECTION TYPE INTERNAL COMBUSTION ENGINE

[75] Inventors: Masaharu Sumiyoshi; Setsuro Sekiya; Katsuhiko Motosugi, all of Toyota; Junzo Uozumi, Nagoya; Tsuneo Ando, Chiryu; Yuzo Takeuchi; Mikio Minoura, both of Nagoya, all of Japan

[73] Assignees: Aisan Industry Co., Ltd., Ohbu; Toyota Jidosha Kogyo Kabushiki Kaisha, Toyota, both of Japan

[21] Appl. No.: 56,310

[22] Filed: Jul. 10, 1979

[30] Foreign Application Priority Data

Nov. 30, 1978 [JP] Japan ..... 53-147148

[51] Int. Cl.[3] ..... F02M 39/00

[52] U.S. Cl. ..... 123/454; 123/531; 123/452; 261/50 A

[58] Field of Search ..... 123/531, 452, 453, 454, 123/455, 457, 460; 261/50 A

[56] References Cited

U.S. PATENT DOCUMENTS

| | | | |
|---|---|---|---|
| 3,029,800 | 4/1962 | Armstrong | 123/459 |
| 4,015,531 | 4/1977 | Stumpp | 123/454 |
| 4,153,026 | 5/1979 | Nagano | 123/452 |
| 4,216,753 | 8/1980 | Inoue | 123/531 |

*Primary Examiner*—Charles J. Myhre
*Assistant Examiner*—Carl Stuart Miller
*Attorney, Agent, or Firm*—Cushman, Darby & Cushman

[57] ABSTRACT

A fuel supplying device for use in fuel injection type internal combustion engine. The device has a fuel metering device operatively connected to an air valve device disposed in the air horn upstream of a throttle valve, fuel supplying means adapted to supply the fuel at a constant supplying pressure to the fuel metering device, a constant differential pressure valve arranged to maintain a predetermined differential pressure across the fuel metering device, and an injector for discharging the metered fuel into the air horn in the vicinity of the throttle valve. The constant differential pressure valve includes a diaphragm type valve arranged to sense and amplify differential pressure across the fuel metering device, and a variable orifice type flow control device arranged to charge flow resistance of the metered fuel. The diaphragm type valve has a function to detect and amplify the differential pressure across the fuel metering device, while the pressure of the metered fuel is controlled by the variable orifice type flow control device which is actuated in response to the differential pressure sensed and amplified by the diaphragm type valve.

8 Claims, 3 Drawing Figures

FUEL SUPPLYING DEVICE FOR USE IN FUEL INJECTION TYPE INTERNAL COMBUSTION ENGINE

BACKGROUND OF THE INVENTION

The present invention relates to a fuel supplying device for use in fuel injection type internal combustion engine and, more particularly, to a fuel supplying device of the kind provided with an air valve disposed in an air horn upstream of a throttle valve. This air valve is provided for maintaining the intake pressure in the air horn at a predetermined level relative to the ambient atmospheric pressure so that the flow quantity of air sucked through the air horn may be in proportion to the opening degree of the air valve.

In the fuel supplying device of the kind described, the fuel is metered by means of a fuel metering device which is operatively connected to the air valve. This fuel metering device incorporates a metering orifice the opening degree of which is controlled in accordance with the opening degree of the air valve. The fuel is fed from a fuel tank to the fuel metering device, by means of a fuel pump, and is metered in accordance with the opening degree of the metering orifice incorporated in the fuel metering device. Thus, the fuel is metered in proportion to the opening degree of the metering orifice, provided that the pressure difference across the fuel metering device, particularly across the metering orifice, is maintained constant.

Namely, since the opening degree of the fuel metering device is in proportion to that of the air valve, the fuel is metered in proportion to the opening degree of the air valve.

A constant differential pressure valve is provided for maintaining a predetermined differential pressure across the fuel metering device. The constant differential pressure valve of a conventional fuel supplying device is arranged to variably restrict the fuel downstream of the fuel metering device, i.e. the metered fuel, in response to the differential pressure across the fuel metering device so as to control the pressure at the outlet of the fuel metering device, thereby to maintain the predetermined differential pressure.

This conventional fuel supplying device, however, has the following disadvantage. Namely, since the fuel metering device is of the type wherein the metered fuel to be supplied to the engine is totally restricted in response to the differential pressure, the conventional constant differential pressure valve should have a relatively large capacity. Usually, this constant differential pressure valve has a diaphragm sensitive to the differential pressure and a nozzle opposing to the diaphragm, between which a clearance is defined so as to restrict the metered fuel. The clearance is varied through the change in the deflection of the diaphragm in response to the change in the differential pressure. The metered fuel flows through this nozzle to an injector, and is discharged from the latter into the air horn.

The orifice diameter of the nozzle must have a increased dimension enough to allow the maximum flow quantity of the metered fuel consumed by the engine. Thus, due to the increased orifice diameter of the nozzle, the precise restriction control of the metered fuel becomes difficult through the change in the clearance between the diaphragm and the nozzle. Since the maximum clearance between the nozzle and the diaphragm should allow the aforementioned maximum flow quantity of the metered fuel, the clearance should change over a wide range in association with the change in the flow quantity of the metered fuel from the minimum to the maximum. This in turn causes an increased lift of the diaphragm between the minimum and maximum clearance positions. In order to have the diaphragm smoothly deflected over a increased lift, the diaphragm has to have a sufficiently large diameter.

The increased diameter of the diaphragm inconveniently results in delay and disturbance in the transient response thereof, although it can improve the accuracy of the control. At the same time, an excessively large lift of the diaphragm may cause a permanent strain of the diaphragm resulting in a deterioration of the precise control and in a lack of its reliability.

To minimize the required capacity of the constant differential pressure valve, it has been proposed to provide a plurality of the fuel metering devices each including the constant differential pressure valve, preferably corresponding to the number of the cylinders of an engine. However, this proposition is not practical, because the increased number of component parts causes the high cost of an engine.

SUMMARY OF THE INVENTION

It is therefore an object of the invention to provide a fuel supplying device capable of overcoming the above-stated problems of the prior art.

To this end, according to the invention, almost all metered fuel coming from the fuel metering device is directly fed to the injector without restriction through the clearance between the nozzle and the diaphragm. Preferably, the metered fuel flows by-passing the constant differential pressure valve, while only a port of the metered fuel is introduced into the constant differential pressure valve to indicate the pressure data of the metered fuel for control purposes.

More specifically, according to the invention, there is provided a fuel supplying device having an air horn, a throttle valve disposed in the air horn, an air valve disposed in the air horn upstream of the throttle valve, a fuel metering device operatively connected to the air valve, means for supplying the fuel at a predetermined pressure to the fuel metering device, a tank in which the fuel to be supplied is stored, a constant differential pressure control valve for maintaining a predetermined differential pressure across the fuel metering device, and an injector arranged to discharge the metered fuel from the fuel metering device to a portion of the air horn in the vicinity of the throttle valve, wherein the constant differential pressure valve includes a diaphragm type valve arranged to sense and amplify the change in the differential pressure across the fuel metering device, and means for variably restricting the metered fuel so as to change the opening degree of the fuel discharging port of the injector in response to the fluctuation of the differential pressure which has been detected and amplified by the diaphragm type valve, whereby the fuel is restricted through a flow resistance given by the restricting means at the final stage, i.e. just before it is discharged from the injector, thereby to control the pressure of the metered fuel, while the diaphragm type valve has only a function to detect the fluctuation of the differential pressure across the fuel metering device.

According to a preferred embodiment of the invention, the diaphragm type valve has first chamber into which the metered fuel downstream of the fuel metering device is introduced, and a second chamber into which the supplied fuel upstream of the fuel metering device is introduced. The first and second chambers are separated from each other by means of a diaphragm which is biased toward the second chamber by means of a spring. A nozzle disposed in the second chamber is provided at its one end confronting the diaphragm with an introduction port and at its other end with a fuel relief port. The fuel relieved from the fuel relief port is returned to a fuel tank through a fixed orifice. As the differential pressure across the fuel metering device is changed, the diaphragm is deflected to change the clearance between itself and the end of the nozzle so as to change the flow of fuel directed from the introduction port to the relief port of the nozzle. Consequently, the fuel pressure upstream of the fixed orifice is largely changed. This change in the fuel pressure is received by a variable orifice type flow control device which in turn controls the opening degree of the fuel discharge port of the injector so as to impart a variable resistance to the flow of the metered fuel, thereby to control the pressure of the metered fuel.

According to the preferred embodiment of the invention, the variable orifice type flow control device is provided in the injector and has a metered fuel chamber into which the metered fuel is introduced, a pilot chamber into which the relieved fuel is introduced upstream of the fixed orifice, a movable piston by which the metered fuel chamber and the pilot chamber are separated from each other, and a piston rod arranged to variably restrict the metered fuel in cooperation with the fuel discharge port. Springs are disposed in the first and the second chambers, respectively, so as to bias the piston in the opposite directions.

The above-explained diaphragm type valve and the variable orifice type flow control device constitute a hydraulic feedback circuit in cooperation with each other.

Due to the provision of this feedback circuit, according to the invention, the differential pressure across the fuel metering device is maintained precisely at the predetermined level, and the require capacity of the diaphragm type valve is reduced so as to afford a compact construction of the fuel supplying device.

Further, according to the preferred embodiment of the invention, the injector is provided with a cylindrical discharging chamber having a nozzle opening which opens to the air horn, and with a plurality of the fuel discharge ports which constitute variable orifices in cooperation with the piston rod end, the fuel discharge ports opening in the direction tangential to the cylindrical discharging chamber. Therefore, the metered fuel through the variable orifices tangentially flows into the cylindrical discharging chamber and is swirled along the inner wall of the cylindrical discharging chamber so that the metered fuel is finely atomized in the air horn to which the metered fuel is discharged through the nozzle opening.

Still further, according to the preferred embodiment of the invention, an air swirl chamber is disposed in such a way as to surround the nozzle opening of the cylindrical discharging chamber, thereby the metered fuel discharged from the nozzle opening is still more swirled so as to improve the atomization of the fuel.

The invention will be more fully understood from the following description of the preferred embodiment taken in conjunction with the accompanied drawings.

DESCRIPTION OF THE PREFERRED EMBODIMENTS

Figure 1:
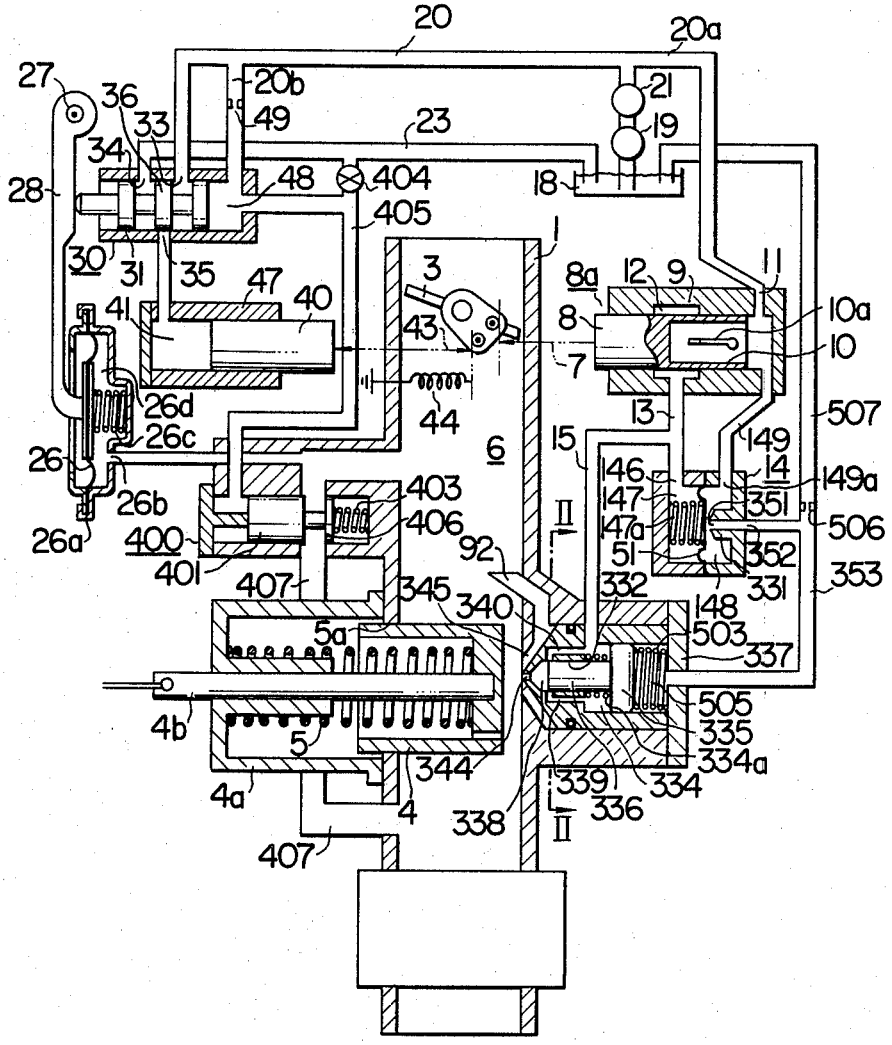
FIG. 1 is a schematic cross-sectional view of a fuel supplying device for an internal combustion engine, constructed in accordance with an embodiment of the invention.

Referring first to FIG. 1 showing a fuel supplying device for an internal combustion engine, constructed in accordance with an embodiment of the invention, the internal combustion engine (not shown) has an air intake duct or an air horn 1 into which air is induced through an air cleaner (not shown) due to the suction action of the engine. In the illustrated embodiment, a piston type throttle valve is used however, a butterfly type throttle valve may be used. This throttle valve has a piston 4 projected into the air horn 1 through an opening 5*a* formed in the wall of the air horn 1. The piston 4 is slidable relative to the air horn 1, and is biased to a throttle valve cut-off position by means of a spring 5 disposed in a cylindrical housing 4*a*.

A piston shaft 4*b* is provided integrally and coaxially with the piston 4. The left end of the piston shaft 4*b* extends outwardly through the bottom of a cylindrical housing 4*a*, and is connected to a link mechanism (not shown) which in turn is operatively connected to an acceleration pedal (not shown) arranged in the front of the driver's seat in a vehicle. An air valve 3 is disposed in the air horn 1 upstream of the piston type throttle valve. The piston 4 of the throttle valve is arranged to open and close the air horn 1 in accordance with the movement of the acceleration pedal, thereby to control the flow of intake air induced into the air horn 1. The air valve is adapted to be operated in response to the flow rate of the intake air in such a manner as to rotate in the opening direction as the flow of the intake air increases. The control is made such that the pressure in a pneumatic chamber 6 defined between the air valve 3 and the piston 4 of the throttle valve is maintained constant in the steady state running of the engine. A feedback control system is provided for this purpose. This feedback control system is arranged to hydraulically operate under the fuel supplying pressure. Namely, the fuel coming from the fuel tank 18 is boosted by means of a fuel pump 19. The pressure of the fuel is then registered by a fuel pressure regulator valve 21. The fuel under the predetermined pressure is then delivered to an inlet port 33 formed in an under-lapped open-center type pilot valve 30. This pilot valve 30 is provided with an return port 34 to which connected is a return pipe 23.

This return pipe 23 is made to communicate directly with the fuel tank 18. Therefore, the pressure in this return pipe is kept substantially equal to the ambient atmospheric pressure. Between the fuel inlet port 33 and the return port 34, disposed in an output port 35 which is in communication with a single acting cylinder 41. The single acting cylinder 41 has a piston 40 linked through a link 43 with a rotary arm for rotating the air valve 3. The air valve 3 is biased in the opening direction by means of a spring 44.

The pilot valve 30 is provided with a pressure chamber 48 into which introduced is a fuel pressure through a fixed orifice 49 from a pipe 20b branching from the fuel supplying pipe 20. This pressure chamber 48 is provided as a fuel pressure regulating chamber for an $O_2$-sensor feedback system which detects signals from an $O_2$-sensor (not shown) disposed in the exhaust pipe of the engine and actuates an $O_2$-sensor actuator 404 to control a return flow from the pressure chamber 48 to the fuel tank 18 so as to adjust the pressure in the pressure chamber 48. During the warming-up running of the engine, the $O_2$-sensor actuator 404 increases the return flow so as to decrease the pressure in the pressure chamber 48. As the pressure in the pressure chamber 48 is decreased, a spool 401 in a fast idle shut-off valve 400 which communicates with the pressure chamber 48 through a line 405, is moved by a bias force of a spring 403. The spool 401 is held in a position where the bias force of the spring 403 is equally balanced with a force produced by the pressure of the pressure chamber 48 acting to the spool 401 on one end surface remote from the spring 403. Therefore, during the warming-up running of the engine, a throttle valve by-pass duct 407 allows the controlled air flow by the fast idle shut-off valve 400 to by-pass the throttle valve and be directly fed into the engine so as to make the warming-up running of the engine satisfactory. This fast idle system is not critical in this specification, because it is not so critical in the present invention.

The $O_2$-sensor actuator 404 is preferably a normal-open solenoid-actuated type valve.

The left end of the spool 31 of the pilot valve 30 abuts on a lever 28 which is pivoted at its upper end to a pivot shaft 27. The lever 28 is connected at its lower end to a diaphragm 26 of an intake air pressure sensor 26a. The diaphragm 26 defines a chamber 26d which communicates with the pneumatic chamber 6 in the air horn 1, through a passage 26b. In the chamber 26d, there is provided a spring 26c which normally urges the diaphragm 26 to the left as shown in the FIG. 1.

As the vacuum in the pneumatic chamber 6 increases, the diaphragm 26 of the intake air pressure sensor 26a is moved overcoming the force of the spring 26c, thereby to rotate the lever 28 counter-clockwise. Consequently, the spool 31 of the under-lapped open-center type pilot valve 30 is pushed and moved to the right so that the outlet port 35 of the pilot valve 30 comes into communication with the return port 34. As a result, the pressure in the cylinder 41 becomes null so as to allow the piston 40 to be retracted by the force of the spring 44. The opening degree of the air valve 3 is increased through this movement of the piston 40 so as to allow a increased amount of air to flow into the air horn 1. Then, the vacuum in the pneumatic chamber 6 is decreased due to the introduction of air so that the diaphragm 26 of the intake air pressure sensor 26a is forced back by the force of the spring 26c. Consequently, the lever 28 is rotated clockwise to release the spool 31 so that the spool 31 is moved leftward to the normal position by the pressure in the pressure chamber 48. The piston 40 of the cylinder 41 is then settled and stabilized in this condition.

To the contrary, as the vacuum decreases in the pneumatic chamber 6, the intake air pressure sensor 26a acts to rotate the lever 28 clockwise so that the spool 31 is moved to the left due to the pressure in the pressure chamber 48, thereby to transmit the fuel supplying pressure to the cylinder 41. As a result, the piston 40 is moved to the right so as to close the air valve 3, thereby to increase the vacuum in the pneumatic chamber 6. Then, the diaphragm 26 rotates the lever 28 counter-clockwise so as to reset the spool 31 of the pilot valve 30 to the normal position.

The pressure in the pneumatic chamber 6 under the steady condition is maintained constant, due to the above-described operation of the feedback control system.

The air valve 3 is connected to a fuel metering device 8a through a link mechanism. This fuel metering device 8a is preferably arranged to meter the fuel supplied to the engine such that the flow of the fuel supplied to the engine is kept in proportion to the flow of intake air. This is achieved by changing the opening degree of the variable orifice type flow control device in proportion to the flow of intake air, provided that the differential pressure across the fuel metering device 8a is kept constant.

Hereinafter, a description will be made as to the fuel metering device 8a. The fuel metering device 8a is constituted mainly by a fuel metering rod 8 coupled to the air valve 3 through a link 7, and a cylinder 9 by which the fuel metering rod 8 is slidably held. The fuel metering rod 8 has a hollow cylindrical end 10 disposed in the cylinder 9. This hollow cylindrical end 10 is provided with a slit 10a which is adapted to cooperate with an annular groove 12 provided in the cylinder 9. Namely, the annular groove 12 and the slit 10a in combination constitute a metering orifice. The cylinder 9 is provided with a fuel receiving port 11 which is in communication with a fuel branch pipe 20a. The fuel under the fuel supplying pressure is introduced into the cylinder 9 through this fuel receiving port 11. The fuel thus introduced then flows into the hollow end portion 10 of the fuel metering rod 8, and reaches the slit 10a. Then, the fuel is metered as it passes through the metering orifice of which the opening degree is determined by the overlap of the slit 10a and the annular groove 12, and flows into a passage 13 as the metered fuel. Since the fuel metering rod 8 is connected to the air valve 3 through the link 7, the fuel can be metered in accordance with the movement of the air valve 3. In order to meter the fuel in proportion to the opening degree of the air valve, it is necessary to maintain a constant differential pressure across the fuel metering device 8a, i.e. between the fuel receiving port 11 and the passage 13 for the metered fuel. To this end, according to the invention, a constant differential pressure valve of a novel construction is incorporated in the fuel supplying device, as will be described hereinunder.

The constant differential pressure valve is constituted mainly by a diaphragm type valve 14 which is adapted to sense and amplify the fluctuation of the differential pressure across the fuel metering device 8a, and a variable orifice type flow control device which is disposed in an injector 337 and arranged to variably restrict the metered fuel fed to the engine in response to the sensed and amplified change in the differential pressure.

The diaphragm type valve 14 includes a first chamber 147 provided with a metered fuel port 146 which is in communication with the passsage 13 of the metered fuel, and a second chamber 148 provided with a supplied fuel port 149a which is in communication with the fuel supplying branch pipe 20a through a passage 149. The first and the second chambers 147, 148 are separated from each other by means of a diaphragm 51. Within the second chamber 148, disposed is a nozzle 331 provided at its one end confronting the center of the diaphragm with an introduction port 351 and at its other end with a relief port 352. The relief port 352 is in communication with the fuel tank 18 through a passage 507 in which disposed is a fixed orifice 506. The arrangement is such that the relieved fuel coming from the relief port 351 is subjected to a resistance which is given by the fixed orifice 506. Thus, the pressure of the relieved fuel upstream of the fixed orifice 506 is raised as the flow of fuel through the relief port 351 is increased. The passage 507 is connected upstream of the fixed orifice 506 to one end of a passage 353 which in turn is connected at its other end to a pilot chamber 505 of the variable orifice type flow control device in the injector 337. A spring 147*a* disposed in the first chamber 147 of the diaphragm type valve 14 is arranged to urge the diaphragm 51 toward the second chamber 148.

The passage 13 for the metered fuel is branched to a passage 15 upstream of the diaphragm valve means 14. The passage 15 is connected to a metered fuel chamber 334 of the variable orifice type flow control device 337.

Figure 2:
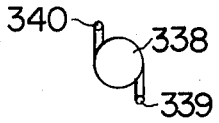
FIG. 2 is an enlarged sectional view taken along the line II—II of FIG. 1.

The pilot chamber 505 and the metered fuel chamber 334 of the variable orifice type flow control device (the injector) 337 are separated from each other by means of a movable piston 335. The movable piston 335 has a piston rod 336 unitary therewith. The piston rod 336 extends across the metered fuel chamber 334 and then through a bore 332 provided in the front portion of the metered fuel chamber 334. The end portion of the piston rod 336 projects into a fuel discharge chamber 338 of the injector 337. The fuel discharge chamber 338 consists of a cylindrical wall portion and a conical dome portion adjacent to the cylindrical wall portion. Two ports 339, 340 communicated with the metered fuel chamber 334 are opened to the fuel discharge chamber 338 in the cylindrical wall portion. As shown in FIG. 2, the ports are angularly spaced apart from each other through 180° degrees and are tangentially directed to the cylindrical wall portion of the fuel discharge chamber 338. Therefore, the metered fuel flowing into the fuel discharge chamber 338 through the ports 339, 340 is swirled along the cylindrical wall portion. Then, the metered fuel swirled is discharged through a nozzle opening 344 to the air horn 1 in the vicinity of the throttle valve. Since the metered fuel discharged to the air horn 1 is swirled, the metered fuel is finely atomized, that is: the fuel discharge chamber 338 serves as a fuel swirling chamber.

An air swirl chamber 345 is formed around the nozzle opening 344, and is arranged to introduce a part of the intake air flowing through the air horn 1 through an air inlet 92 so as to generate a swirl flow. Consequently, the fuel swirled and discharged from the fuel discharge chamber 338 through the nozzle opening 344 is further swirled in the air swirl chamber 345 so as to be further atomized into fine particles:

The inner diameter of the cylindrical wall portion of the fuel discharge chamber 338 is substantially equal to the diameter of the piston rod 336. The free end of the piston rod 336 is arranged to cooperate with the ports 339, 340 so as to constitute together variable orifices. Springs 334*a*, 503 are disposed in the metered fuel chamber 334 and the pilot chamber 505, respectively, to bias the piston 335 toward the opposite directions.

The constant differential pressure valve of the aforementioned construction is operated in the manner as described hereinunder.

When the differential pressure across the fuel metering device 8*a*, i.e., the differential pressure between the fuel receiving port 11 and the passage for the metered fuel is changed from the predetermined value, for instance, it is assumed here that the pressure in the passage 13 is increased so as to decrease the above-mentioned differential pressure, the diaphragm 51 of the diaphragm type valve 14 is moved toward the second chamber 148 so as to reduce the clearance between the end of the nozzle and the diaphragm 51. As a result, the fuel flow into the introduction port 351 is restricted through the narrower clearance so that the flow rate of the fuel which is relieved into the fuel tank 18 through the relief port 352 and the fixed orifice 502, is reduced, thereby to abruptly lower the pressure in the passage 353. For this reason, the pressure in the pilot chamber 505 of the variable orifice type flow control device is abruptly lowered and the pressure in the metered chamber 334 becomes relatively higher so as to cause a movement of the movable piston 335 toward the pilot chamber 505. The ports 339, 340 are then opened to a large opening degree which allows the fuel flow into the fuel discharge chamber 338 of the injector 337 through a smaller resistance. Due to the fuel flow through the smaller resistance, the pressure in the passage 13 is lowered to negate the aforementioned increase of the pressure in the same passage, thereby to recover the predetermined differential pressure across the fuel metering device.

To the contrary, as the pressure in the passage 13 is reduced, the diaphragm 51 of the diaphragm type valve 14 is moved toward the first chamber 147 so as to increase the clearance between itself and the nozzle 331. Consequently, the fuel flow from the introduction port 351 to the tank 18 through the relief port 352 is increased. Due to the arrangement of the fixed orifice 506, the increased fuel flow causes the pressure in the passage 353 and, accordingly, in the pilot chamber 505 to abruptly increase so that the movable piston 335 moves toward the metered fuel chamber 334. Thereby, the opening degree of the ports 339, 340 is reduced so that the fuel flow from the metered fuel chamber 334 to the fuel discharge chamber 338 is restricted. Thus, the pressure in the passage 13 increase to compensate for the aforementioned reduction of the pressure in the same passage.

It will be understood that the diaphragm type valve 14 and the variable orifice type flow control device in the injector 337 constitute, in combination, an integration type automatic feedback control system. Therefore, the differential pressure across the fuel metering device 8*a* is precisely controlled at a predetermined constant value so as to make it possible to meter the fuel in proportion to the movement of the air valve 3. At the same time, the diameter of the diaphragm 51 of the diaphragm type valve 14 is considerably reduced as compared with the diaphragm of the conventional constant differential pressure valve. Further, the transient response to the fuel metering is improved and no hunting takes place.

Although the invention has been described through a specific embodiment, it is to be understood that this description is not of limiting sense but, rather, various changes and modifications may be imparted to the embodiment without departing from the spirit and scope of the invention which is limited solely by the appended claims.

Figure 3:
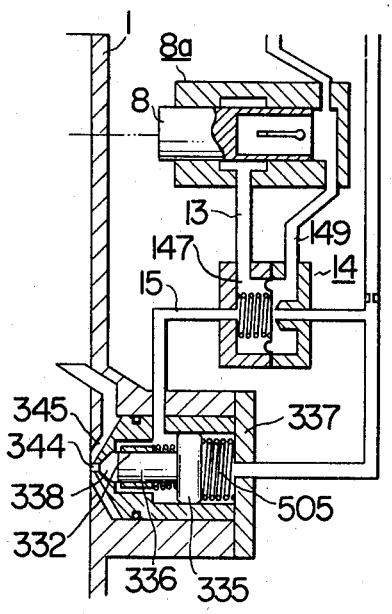
FIG. 3 is an illustration of an essential part of a modification of the embodiment.

For instance, while in the described embodiment the passage 13 and 15 are provided to make almost whole part of the metered fuel by-pass the diaphragm type valve 14 of the constant differential pressure valve, it is possible to arrange the diaphragm type such that the metered fuel flows through the first chamber 147 of the diaphragm type valve 14, as shown in FIG. 3.

What is claimed is:

1. In a fuel supplying device for a fuel injection type internal combustion engine, comprising:

(a) an air horn, (b) a throttle valve disposed in said air horn, (c) an air valve disposed in said air horn upstream of said throttle valve, (d) a fuel metering device operatively connected to said air valve, (e) fuel supplying means adapted to supply fuel at a predetermined fuel pressure to said fuel metering device, (f) a fuel tank, (g) an injector arranged to discharge the fuel metered by said fuel metering device into said air horn in the vicinity of said throttle valve, and (h) a constant differential pressure valve arranged to maintain a predetermined differential pressure across said fuel metering device, and including a diaphragm type valve arranged to sense and amplify differential pressure across said fuel metering device, and a variable orifice type flow control device provided in said injector and arranged to operate in response to the differential pressure sensed and amplified by said diaphragm type valve, the improvement wherein said diaphragm type valve comprises a first chamber into which the metered fuel downstream of said fuel metering device is introduced, a second chamber into which the supplied fuel upstream of said fuel metering device is introduced, a diaphragm by which said first and second chambers are separated from each other, a first spring disposed in said first chamber and arranged to bias said diaphragm toward said second chamber, and a nozzle disposed in said second chamber and provided at its end confronting said diaphragm with an introduction port and at its other end with a fuel relief port through which fuel returns to said fuel tank through a fixed orifice, while said variable orifice type flow control device comprises a metered fuel chamber into which the metered fuel is introduced, a pilot chamber into which the relieved fuel through said relief port upstream of said fixed orifice is introduced, a movable piston by which said chambers are separated from each other, a piston rod unitary with said movable piston, a second spring disposed in said metered fuel chamber and arranged to bias said movable piston toward said pilot chamber, a third spring disposed in said pilot chamber and arranged to bias said movable piston toward said metered fuel chamber, and a variable orifice actuated by said piston rod.

2. A fuel supplying device as claimed in claim 1, wherein said injector comprises a fuel discharge chamber having a nozzle opening which opens into said air horn, said fuel discharge chamber is a cylindrical chamber having an inner diameter substantially equal to the diameter of said piston rod, and at least two ports tangentially opening into said cylindrical chamber, said variable orifice being made in combination of said piston rod and said ports, the metered fuel flowing into said cylindrical chamber through said ports tangential to said cylindrical chamber so as to be swirled in said cylindrical chamber, thereby, the metered fuel swirled is sprayed into said air horn in an atomized state.

3. A fuel supplying device as claimed in claim 2, wherein said cylindrical chamber comprises a cylindrical wall portion having a diameter substantially equal to the diameter of said piston rod, to which portion said ports open, and a conical dome portion, adjacent to said cylindrical wall portion, tapering toward said nozzle opening from said conical wall portion.

4. A fuel supplying device as claimed in claim 3, wherein said ports communicates with said fuel metered chamber.

5. A fuel supplying device as claimed in claim 4, wherein said ports are plural in number.

6. A fuel supplying device as claimed in claim 5, wherein said ports are two in number, being angularly spaced by 180° degrees.

7. A fuel supplying device as claimed in any one of claims 1, 2, 3, 4, 5 and 6, wherein an air swirl chamber is provided so as to surround said nozzle opening, and a plurality of air ports open into said air swirl chamber so that air introduced into said air horn flows into said air swirl chamber in which air swirls to promote the atomization of the metered fuel sprayed in said air horn.

8. A fuel supplying device as claimed in claim 1, wherein all the metered fuel is introduced through said diaphragm type valve to said variable orifice type flow control device from said fuel metering device.

* * * * *